US010005297B2

(12) United States Patent
Angulo Navarro et al.

(10) Patent No.: US 10,005,297 B2
(45) Date of Patent: Jun. 26, 2018

(54) PRINTER AND METHOD OF PRINTING

(71) Applicants: HEWLETT-PACKARD DEVELOPMENT COMPANY, L.P., Houston, TX (US); Emilio Angulo, Sant Cugat del Valles (ES); Diego Lopez, Sant Cugat del Valles (ES); Sergi Culubret, Sant Cugat del Valles (ES)

(72) Inventors: Emilio Angulo Navarro, Barcelona (ES); Diego Lopez Ubieto, Sant Cugat del Valles (ES); Sergi Culubret, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/303,981

(22) PCT Filed: Apr. 23, 2014

(86) PCT No.: PCT/EP2014/058226
§ 371 (c)(1),
(2) Date: Oct. 13, 2016

(87) PCT Pub. No.: WO2015/161873
PCT Pub. Date: Oct. 29, 2015

(65) Prior Publication Data

US 2017/0120634 A1 May 4, 2017

(51) Int. Cl.
*B41J 11/66* (2006.01)

(52) U.S. Cl.
CPC ..... *B41J 11/663* (2013.01)

(58) Field of Classification Search
CPC .... B41J 2/04541; B41J 2/0457; B41J 11/663; A01B 12/006
See application file for complete search history.

(56) References Cited

U.S. PATENT DOCUMENTS 2,619,897 A 12/1952 Lawrence et al.
7,011,390 B2 3/2006 Silverbrook
(Continued)

FOREIGN PATENT DOCUMENTS

CN 101654025 2/2010
CN 103386825 11/2013
(Continued)

OTHER PUBLICATIONS

Ikeda, Akira. Applications for On-Demand Flatbed Rinter & Cut Combination system. Mimaki Engineering Co., Ltd. (Japan). 2001.
(Continued)

*Primary Examiner* — Lamson Nguyen
(74) *Attorney, Agent, or Firm* — HP Inc. Patent Department

(57) ABSTRACT

A printer comprises a printing assembly for printing an image on a print media in a print zone; a cutting assembly for cutting the print media along a contour in a cut zone; wherein the print zone and the cut zone are distinct from one another, one of the zones being downstream of the respective other zone in a print media advance direction; a control unit controlling the printhead assembly and the cutting assembly to perform printing and cutting operations during a single print media feed. A method of printing, using said printer, comprises feeding the print media through the cut zone and through the print zone, in any order; and simultaneously printing an image and cutting a contour while the print media is being fed through the cut zone and through the print zone.

20 Claims, 9 Drawing Sheets

(56) References Cited

U.S. PATENT DOCUMENTS

| | | | |
|---|---|---|---|
| 7,246,961 | B2 | 7/2007 | Gilmour |
| 2010/0119282 | A1 | 5/2010 | Olsen et al. |
| 2012/0121308 | A1 | 5/2012 | Higuchi et al. |
| 2012/0299991 | A1 | 11/2012 | Wakita |

FOREIGN PATENT DOCUMENTS

| | | |
|---|---|---|
| KR | 10-2005-0010472 | 1/2005 |
| WO | WO-2013101126 | 7/2013 |
| WO | WO-2015161873 | 10/2015 |

OTHER PUBLICATIONS

Roland DG VS-I Series Features. http://www.rolanddg.co.uk/products/print-and-cut/vs-series?tab=1.

PRINTER AND METHOD OF PRINTING

Sometimes, it is desirable to print on and cut the same medium, for example for producing stickers and labels of different designs and shape. More generally, printing and cutting can be part of processing any type of print medium, without being limited to a particular application or technology. To manage print and cut processes, it is possible to first print on the medium using a common printer and then use a cutting device that is separate from the printer. The cutting device also may be integrated with or attached to a printer already. These processes may be performed on web media or individual sheets of print media, for example, and further may use any type of printing technology, such as inkjet printing, laser printing, thermal-transfer printing, electrophotographic printing, etc. without being limited to any one technology.

DETAILED DESCRIPTION

Figure 1:
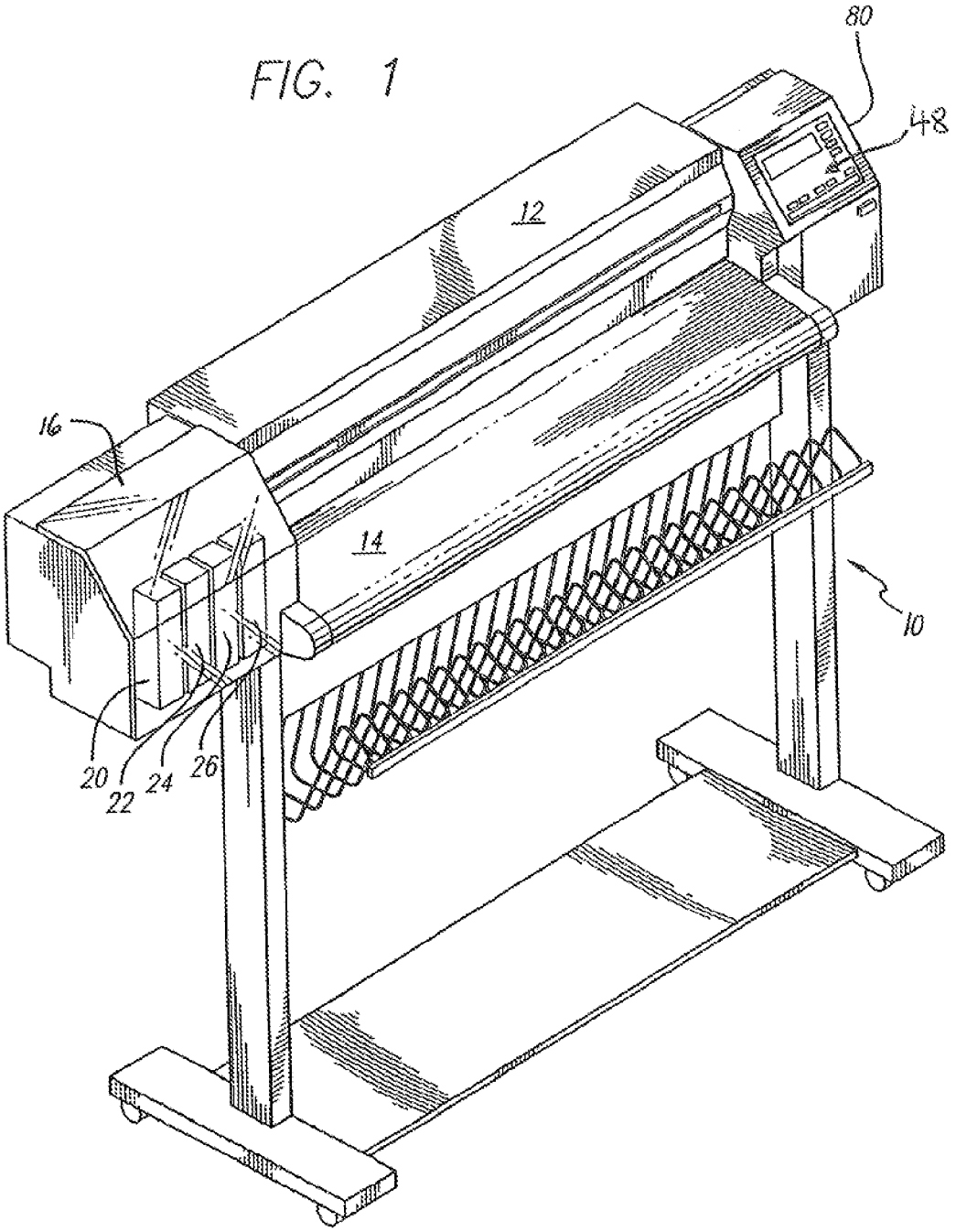
FIG. 1 shows a schematic diagram of an example of a printer.

FIG. 1 shows an example of a large format printer 10 of the type which includes a transversely movable printhead carriage enclosed by a cover 12 which extends over a generally horizontally extending platen 14 over which printed media is discharged. At the left side of the platen is a cover 16 which covers four removable ink reservoirs 20, 22, 24, 26 which, through a flexible tube arrangement, supply ink to four inkjet printheads mounted on the moveable carriage.

Figure 2:
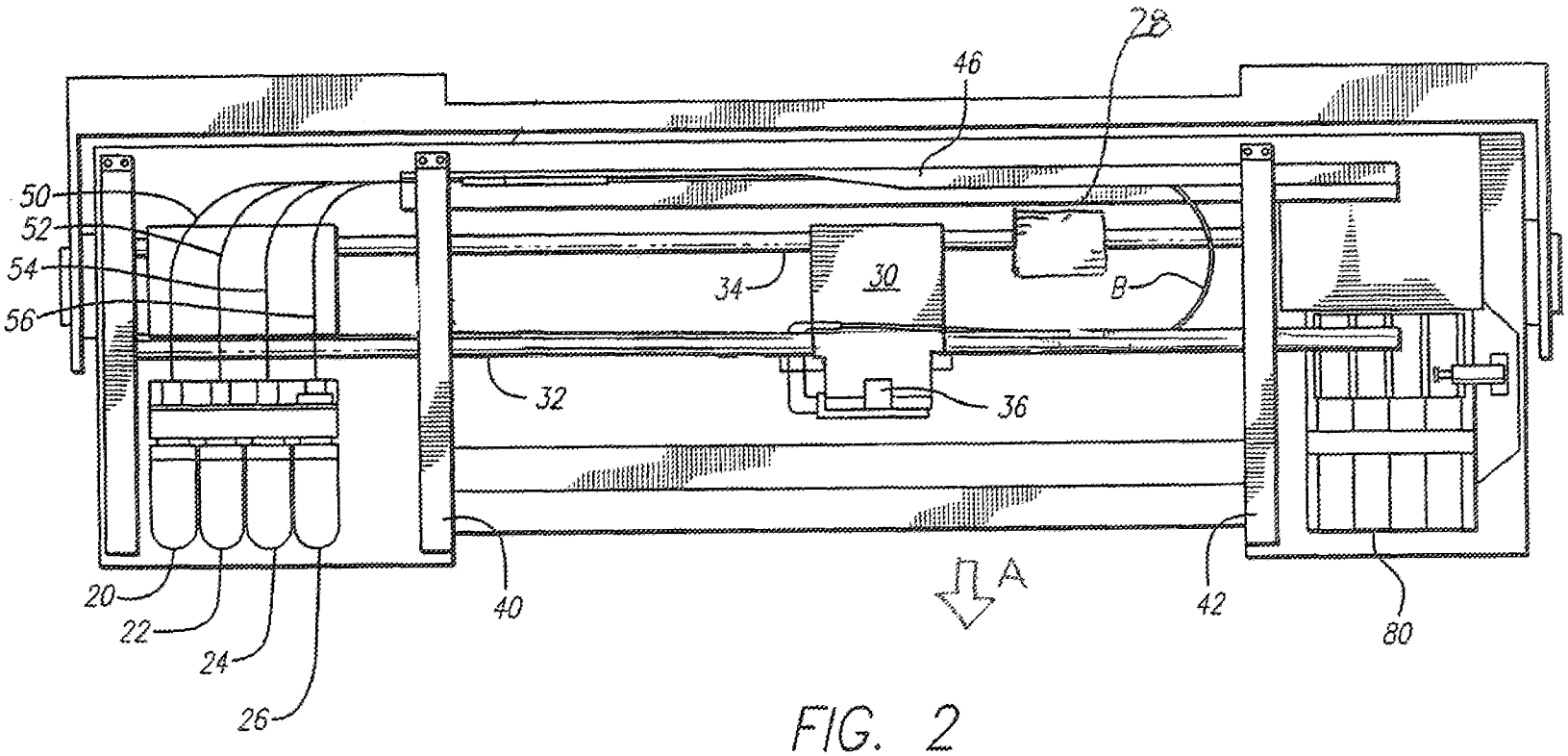
FIG. 2 shows a plan view of the printer of FIG. 1, with the cover removed to expose a printing assembly and a cutting assembly.

In the plan view of FIG. 2 in which the cover 12 has been removed, it is seen that the printhead carriage 30 is mounted on a transversely extending slider rod or guide 32 which in turn is rigidly affixed to the frame of the printer. Further, as cutting tool carriage 28 is mounted on a transversely extending slider rod or guide 34 which in turn is rigidly affixed to the frame of the printer. Also rigidly affixed to the frame of the printer is a pair of tube guide support bridges 40, 42 from which a rear tube guide 46 is suspended. The printhead carriage 30 is part of a printing assembly and the cutting tool carriage 28 is part of a cutting assembly.

In this example, a flexible ink delivery tube system conveys ink from the four separate ink reservoirs 20, 22, 24, 26 at the left side of the printer through four flexible ink tubes 50, 52, 54, 56 which extend from an ink reservoirs through rear and front tube guides 44, 46 to the carriage 30 to convey ink to four printheads on the carriage 30.

At the right side of the printer is a printhead service station 80 at which the printhead carriage 30 may be parked for servicing such as wiping, spitting or priming the printheads.

In this example, a feed stock of standard print medium (not shown) can be housed below cover 12 and can be directed along a media pathway below the cutting tool carriage 28 and then below the printing carriage 30. The media advance direction is illustrated by arrow A. The resulting product of the printer is a printed output having varying printed images and cut contours (not shown in FIGS. 1 and 2).

The printer 10 shown in FIG. 1 is a large format desktop printer. This disclosure can be used in desktop printers as well as in large format printers. Moreover, printers of various sizes are contemplated. FIG. 1 illustrates an operation panel 48 behind which a printer controller is located. While the printer controller is not explicitly shown in FIGS. 1 and 2, it is understood that the printer controller may be connected to a work station not shown) or other control unit by a wireless or other interface.

The print medium may take the form of a media roll or web stored in the printer or at the back of the printer and also may be separate media sheets. The media roll may be of any size. The roll size may depend on the printer used. The print medium is first fed to the cutting assembly, wherein it is fed below the cutting tool carriage 28 for cutting desired contours, and then to the printing assembly, past the printhead carriage 30 where a continuous stream of plots can be printed. First cutting and then printing avoids the risk that the cutting process might spoil the print out if it is not yet fully dry when the medium reaches a cut zone shortly after having received a print fluid. Nonetheless, the order of cutting and printing may be reversed in other printer configurations.

Media may also be discrete media sheets of any size, as dictated by the size of the printer. The sheets, similar to a media roll, may be fed directly to the cutting assembly. Alternatively, the sheets may be created using a pre-print cutter, which cuts a continuous media web into discrete sheets prior to the media web reaching the printing assembly. The cut media sheets are then fed into the printing assembly.

Media may comprise any type of printing medium, including but not limited to paper, cardboard, foil, laminated sheets, multi-layer structures, such as vinyl media backed with an adhesive layer and a cover layer, etc.

The printhead carriage 30 of this example can hold four printheads of the type typically found in inkjet printers. Other types of printing assemblies are contemplated, including, but not limited to, mechanisms for laser printers, electro-photographic printers, thermal-transfer printers, and liquid electro-photographic printers.

As shown, the printing assembly includes a number of printheads mounted on the carriage 30 which travels on the carriage rod 32 across a print zone, the movement being transverse to the media pathway and media advance direction A. The cutting assembly comprises a cutting tool mounted on a cutting tool carriage 28 which travels on carriage rod 34. The cutting tool can be designed to move both in the direction of the media pathway and perpendicularly thereto by moving the carriage 28 along the carriage rod 34 and by moving the tool relative to the carriage 28.

The printing system operates such that a user defines the size and quantity of images to be printed and contours to be cut. The contours to be cut may but do not have to correspond to the contours of the images to be printed. The printing system includes a processor (not shown), which coordinates the overall system and controls the print engine to produce the desired output. For example, after cutting part of a contour transport rollers are directed by the processor to advance the medium to the printing assembly. While the medium continues to be fed through the print media pathway, it reaches the printing zone and the printing assembly starts to print desired images, while the cutting assembly continues to cut further parts of the contour. The final printed and cut output is then gripped by output rollers and directed out of the printer. The processor controls the process by controlling drives associated with rollers. As indicated above, the order of printing and cutting may be reversed.

The cutting tool can comprise a blade cutter adapted to cut in any direction across the surface of the print medium. The cutting assembly is generally driven by an electric motor (not shown) and is typically compact and safe. Other types of cutting assemblies are contemplated, including but not limited to, laser cutters, and chemical fluid cutters which operate based on a chemical cartridge similar to an inkjet printhead.

Figure 3:
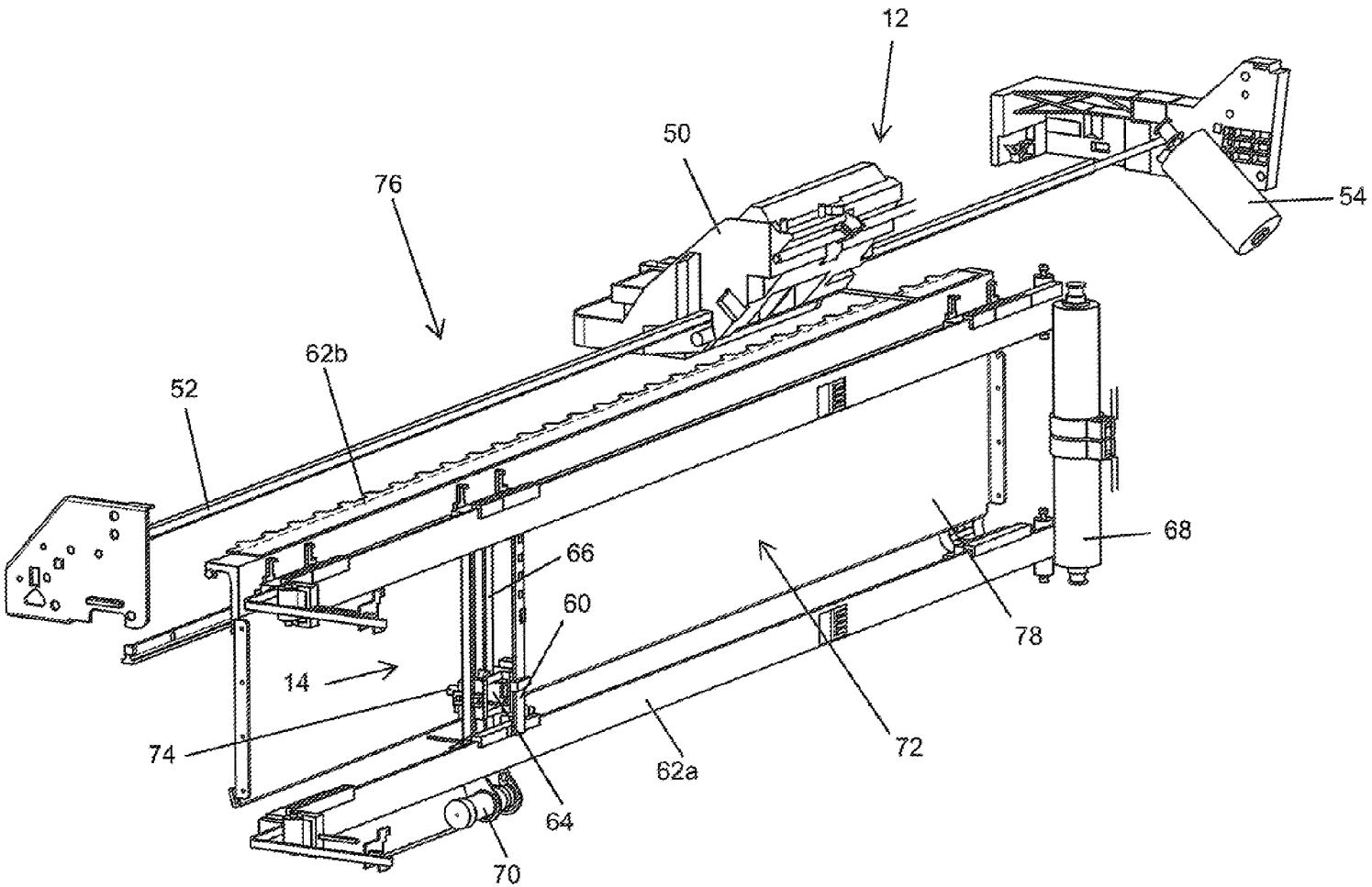
FIG. 3 shows another example of a printing assembly and a cutting assembly in a printer.

FIG. 3 shows an alternative example of printing and cutting assemblies of a printer. In this example, the printer may be an inkjet printer, processing a media roll or web (not shown). FIG. 3 shows a top view of the printing and cutting assemblies wherein a print medium advances below the cutting assembly and the printing assembly.

In detail, FIG. 3 shows a printing assembly 12 including a carriage 50 travelling on a carriage rod 52 in a direction perpendicular to the direction of media advance. The carriage 50 is driven by an electric motor 54 which is controlled by a printer controller (not shown). The carriage 50 receives a number of print cartridges (not shown), e.g. inkjet cartridges or any other suitable printing device.

The cutting assembly 14 comprises a cutting tool carriage 60 which travels along a carriage frame 62, the frame 62 including two parallel bars 62*a*, 62*b*. The carriage 60 comprises a tool sled 64 which travels along a tool sled rail 66. The movement of the cutting carriage 60 along the cutting frame 62, in a direction perpendicular to the media advance, is driven by an electric motor 68. The movement of the tool sled along the sled rail 66, in a direction parallel to media advance, is driven by an electric motor 70. The tool sled 64 hence can move both in a direction perpendicular to media advance and parallel thereto. The area spanned by the travelling tool sled 64 is designated as a cut zone 72. The tool sled 64 carries a cutting tool 74 for cutting or slicing a print medium which moves through the cut zone 72. The cutting tool can comprise a cutting blade, a laser device, a chemical cutting fluid cartridge or any other suitable cutting tool.

Figure 3A:
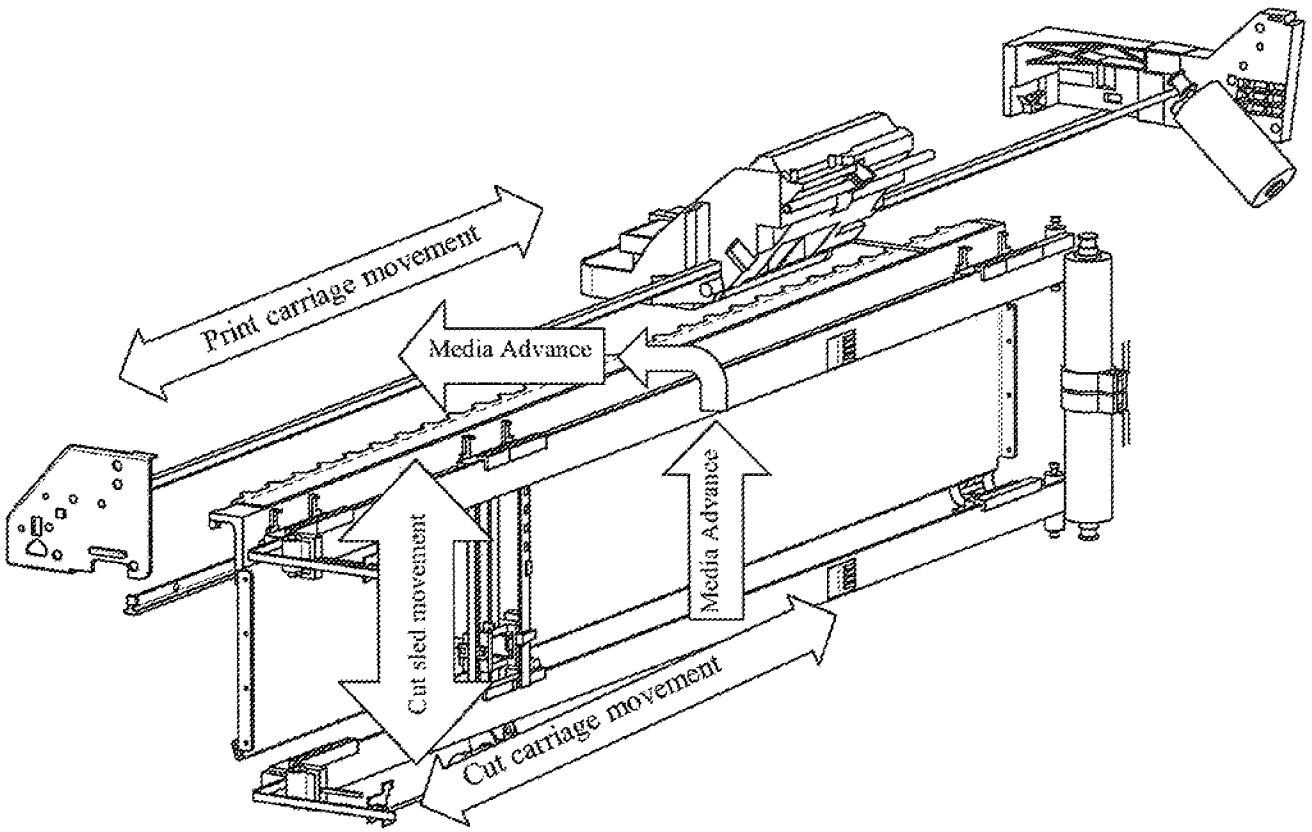
FIG. 3A shows a similar view as FIG. 3, additionally indicating dynamics of the printer.

The direction of media advance and the direction of movement of the printing carriage, the cutting carriage and the cutting sled are shown schematically in FIG. 3A.

In the example of FIGS. 3 and 3A, a print medium advances first through the cut zone 72 and then through a printing zone 76, beneath the cutting assembly 14 and the printing assembly 12. The print medium is supported by a printer platen (not shown) in the print zone 76 and by a cutting platen 78 in the cut zone 72.

An example of the operation of the printing and cutting assemblies is now described with reference to FIGS. 4 to 6.

The example described herein relates to printing and cutting of stickers or labels where the contour of an image to be printed and the contour to be cut are approximately the same and wherein the cutting assembly slices a top layer of a medium which is a multi-layer structure including a top layer of vinyl backed with adhesive. The process can be readily adapted to cutting or slicing any other type of media and further to cutting a contour which is different from the contour of the image to be printed.

In general, the cutting process is happening at the same time as the image or images are being printed. Cutting and printing can proceed while the medium is always advancing in a forward direction, as usual in a printer. There are two different zones defined in this process, as shown in FIG. 4, one is the cut zone 80 and the other is the print zone 82. As shown in FIG. 4, both the cut zone 80 and the print zone 82 span the entire width of the print medium. The length of the print zone, in the direction of media advance, is determined by the width of the print head, more precisely the width of a swath that can be produced by the printhead, as usual in a printer. The length of the cut zone 80, designated as 2*l* in FIG. 4, is determined by the configuration of the cutting assembly or, more generally, by the area which the cutting tool is able to move across.

Figure 4:
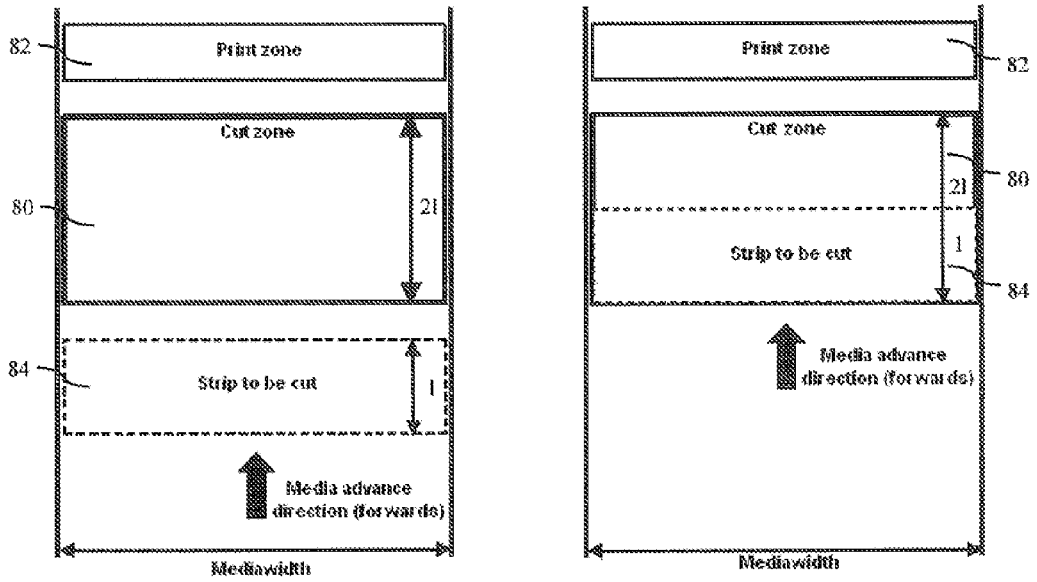
FIGS. 4, 5, and 6 show a sequence of steps of processing a print medium according to one example.

As the media is advancing forward through the cut zone 80 and the print zone 82, in the example shown in FIG. 4, the maximum length l of a strip to be cut 84 is half of the length, 2*l*, of the cut zone 80 available, when using the cutting assembly of FIG. 3. This is so because, for cutting any given contour, the cutting tool of FIG. 3 is able to reach any point on the "strip to be cut" 84 only as long as this "strip to be cut" 84 fully overlaps with the cut zone 80 while it is travelling through said cut zone. Accordingly, in the example described, for printing and cutting a given image having a given contour, the contour is divided into "strips to be cut", each strip having a length a half of the length of the cut zone 80. This is described in more detail with respect to FIG. 5.

Figure 5:
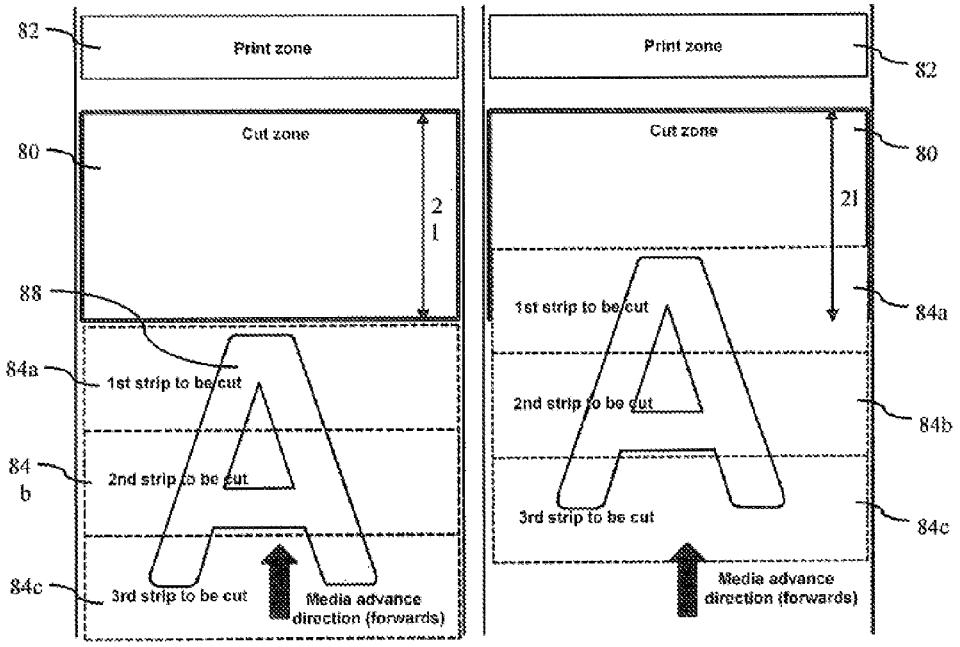
Figure 6:
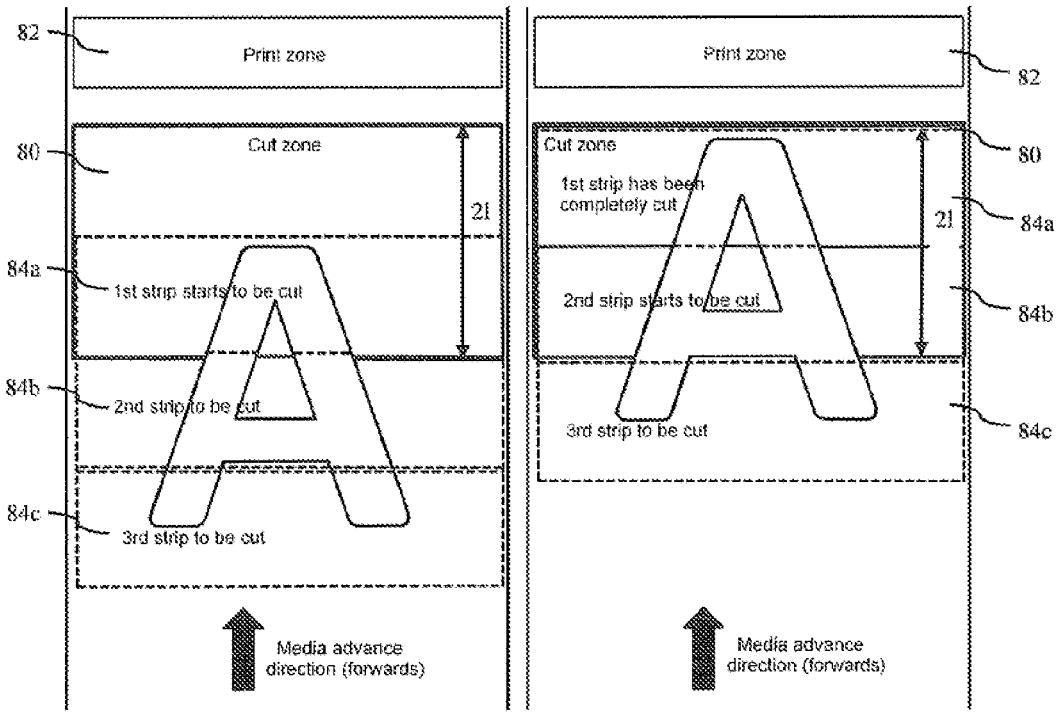

FIG. 5 shows an example where an image to be printed and a contour to be cut correspond to the letter "A" 88. This image is divided into three strips 84*a*, 84*b*, 84*c*, each strip having a length l which is half of the length 21 of the cut zone 80. FIG. 5 shows how the first strip 84*a* is just entering the cut zone 80. Using the cutting tool of FIG. 3, the cutting tool can start to cut the first strip 84*a* once the strip to be cut has completely entered cut zone 80. This situation is shown in FIG. 6, on the left hand side. While the first strip 84*a* moves through the cut zone 80, the contour of the letter "A" within this first strip is being cut. Once the cutting tool has finished cutting the first strip, the second (next) strip 84*b* has just completely entered the cut zone 80 and the first strip 84*a* starts to leave the cut zone 80. This situation is shown in FIG. 6, on the right hand side. The cutting tool then starts to cut the next part of the contour within the second strip 84*b*.

While the cutting tool continues to cut the contour within the second strip 84*b*, the third strip 84*c* and further strips (not shown), the print media continues to advance in the media advance direction (forward direction) and starts to enter the print zone 82. Once the print media enters the print zone 82, the print head starts printing the image in subsequent swathes, as a typical printer does.

The cutting and printing operation implies some processing of a print job received by a printer. Processing can be performed in a printer controller within the printer or in as work station before the print job is being sent to the printer. For adjusting the operation of the cutting assembly and the printing assembly, the following may be taken into account:

The time which the cutting tool needs to complete cutting of an entire strip 84*a*, 84*b*, 84*c*, depending on the dynamics of the cutting movement, such as velocity and acceleration, and also how complex the contour to be cut is; and the desired printing throughput and/or the printing mode which determine the media advance speed in view of the printing operation. The time between a strip having fully entered the cut zone and before starting to leave the cut zone, i.e. the time during which said strip is accessible to the cutting tool, is selected so that the cutting tool can complete cutting of the partial contour within said strip. This time period for cutting the contour within one strip should be equal or less than the time period for printing a partial image in subsequent swathes corresponding to strip of the print medium. The media advance speed and the printing speed are adjusted accordingly.

Figure 7:
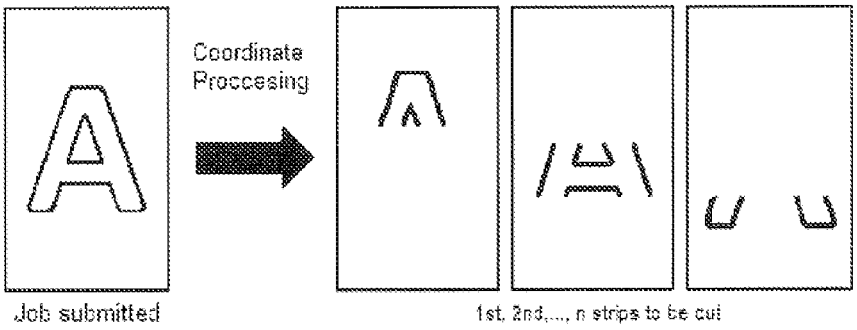
FIG. 7 schematically illustrates processing of image/contour data according to one example.

Whenever a print job is submitted to the printer, there will be a file or other data unit that contains the image data and the coordinates of the contour of the image to be cut. These data may be processed to generate the coordinates for each strip according to the cut zone available, as schematically shown in FIG. 7.

According to the time calculated to cut each strip, a media advance speed can be calculated which also determines the maximum printing throughput, under consideration of the fastest printing mode allowed. If a selected printing mode allows a second media advance speed which is equal to or higher than a first media advance speed determined by the cutting operation, said first media advance speed will be selected. If a very high quality printing mode is selected, it might require a third slower media advance speed than the cutting operation, and the media advance speed shall be reduced accordingly. In many cases, the fastest print mode allowed to print an image and a media advance speed for cutting a corresponding contour in parallel result in the same or similar media advance speeds so that the printing throughput is not or little affected by the parallel cutting operation. Only if contours to be cut are very small and/or very complex, the media advance speed allowed for the cutting operation might be slower than the one that would be used if printing only. Even in this case, printing and cutting images and contours in parallel using the method described is faster than printing and cutting in sequence and also faster than printing and cutting by repeatedly moving the print medium forwards and backwards.

Figure 8:
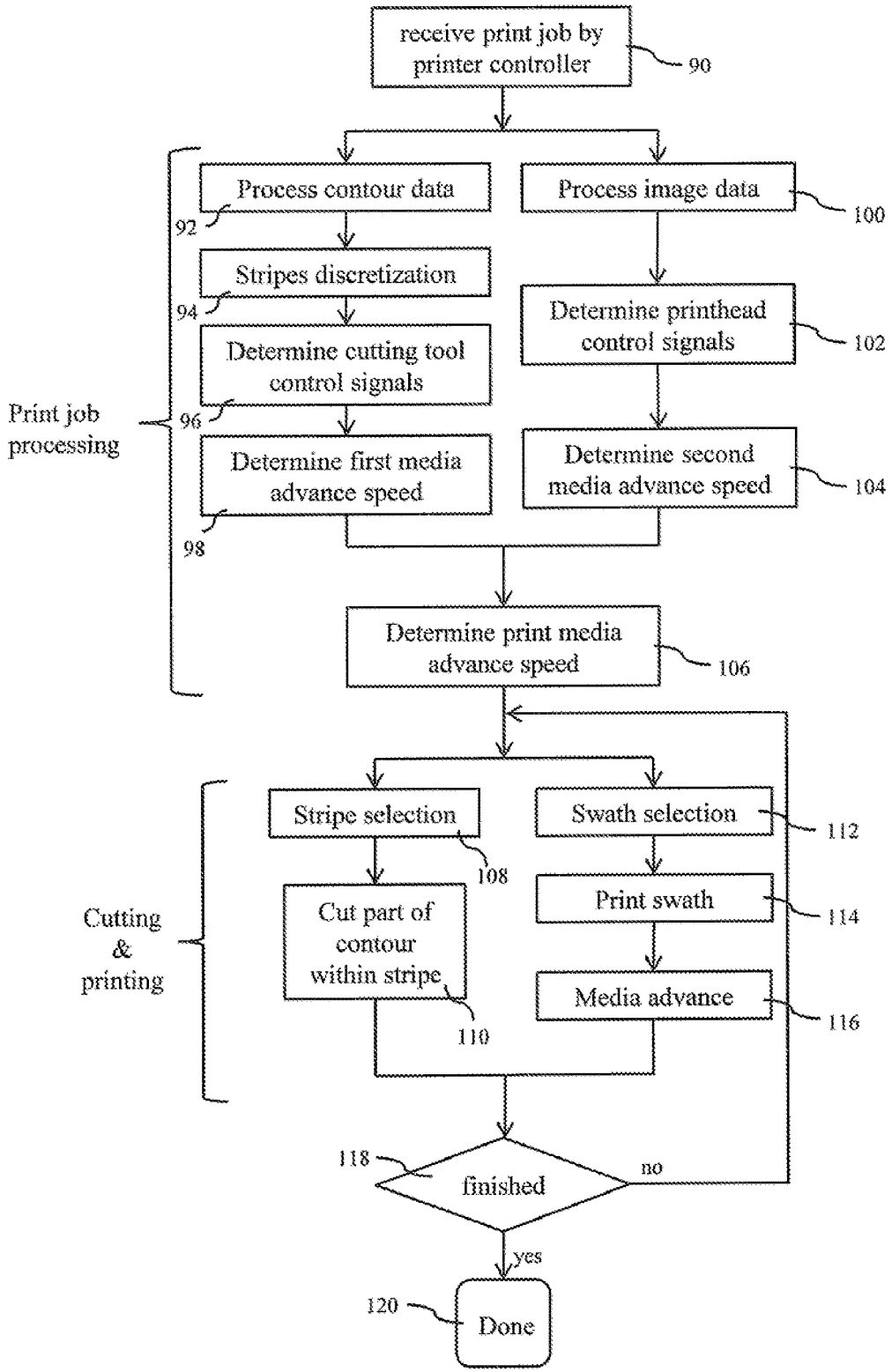
FIG. 8 shows a flow chart of an example of a method of printing.

FIG. 8 shows a flow diagram of an example of a method of printing. In a first step 90, the printer receives a print job which may be transmitted to a printer controller via a wireless interface or cable from a work station or from a remote device. The print job includes data defining an image to be printed and a contour to be cut wherein the contour may be the contour of the printed image but also can be a contour which is independent from the image. For example, the print job can define printing and cutting of labels or stickers.

In step 92, the printer controller processes the data submitted with the print job by determining a cutting contour and, in step 94, divides the cutting contour into discrete strips which are adapted to the cut zone and the technology used for the cutting tool. When processing the cutting contour, in step 98, the printer controller also determines control signals for driving the cutting tool 96 and further determines a first (maximum) media advance speed at which the cutting tool is still able to cut the desired contour while the print media is fed in a print media advance (forward) direction.

In step 100, the printer controller further processes the image data under consideration of a selected print mode to determine control signals (step 102) for the printing assembly and a second (maximum) print media advance speed (step 104) for printing the image at the selected print mode.

As a result, in step 106, the print job is processed so that a print media advance speed for performing both cutting and printing operations is calculated and corresponding control signals for driving the printing assembly and the cutting assembly are obtained. Based on these control signals, drive rollers are driven and the print medium is fed through the printer so that it enters the cut zone and the print zone, as shown and explained with respect to FIGS. 2 to 6. As long as the print job has not yet been finished, the printing and cutting operations are carried out in parallel.

For performing the cutting and printing operations, in step 108, the printer controller selects the coordinates of the strip to be cut within the cut zone at any given time, and determines the coordinates of the contour to be cut. In step 110, a cutting tool is driven to cut the contour within the respective strip while the print medium advances through the cut zone. At the same time, in step 112, the printer controller selects the swath to be printed on the part of the medium which is within the print zone and, in step 114, controls the print heads to print the respective swath. After printing each swath, in step 116, the print medium is advanced, depending on the print mode selected and the media advance speed determined. Printing and cutting hence proceeds simultaneously wherein the media advance speed is adapted so that the image can be printed in the selected print mode and the contour can be cut while the print medium advances through the cut zone. In the example described, either after cutting each strip or after printing each swath, the printer controller checks whether the printing and cutting processes are completed (step 118). If yes, the print medium is output from the printer (step 120); if no, the next section of the print medium is processed.

The processing steps described with reference to FIG. 8 can be performed in different order from the one shown. They can be performed sequentially or, at least in part, simultaneously. Processing of the print job can be performed in a printer controller within the printer or by a data processing system external to the printer. The method of processing the print job can be implemented in software including machine readable instructions which can be stored on a non-transient storage medium internally or externally from the printer.

The printer and printing method described offer a way to print and cut in parallel so as to optimize the total time to get a plot printed and cut. Because the print medium advances only in one direction, namely the print media advance forward direction, it is possible to implement an unlimited length of printing and cutting workflows and even perform printing and cutting unattended for an extended period of time. There is no limit on the length of print medium to be processed because there are no backward movements.

Further, as the print medium is moving in only one direction, feeding of the print medium can be performed easily and in a straightforward manner by driving drive rollers in only one direction. It is not necessary to take any special precaution for holding and aligning the print medium. Holders for pressing the print medium to drive rollers will press the medium only once so that holder marks can be avoided. No realignment of the print medium is necessary and the position of alignment depends only the mechanical system but not on other factors, such as media weight. Because a plot is printed and cut in the same machine, both operations being performed simultaneously, the overall time spent in obtaining the plot is very short and it usually is possible to keep common printing speeds, as determined by the printing mode, so that printing throughput is high.

Figure 9:
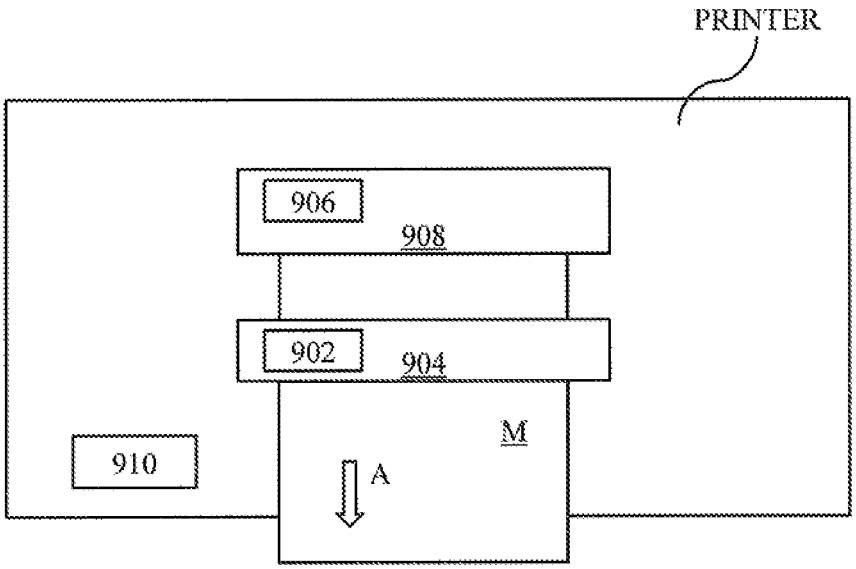
FIG. 9 shows a schematic diagram of another example of a printer.

In one example, schematically shown in FIG. 9, a printer comprises a printhead assembly 902 for printing an image on a print media (M) in a print zone 904, and a cutting assembly 906 for cutting the print media along a contour in a cut zone 908. The print zone and the cut zone are distinct from one another, and one of the zone is downstream of the respective other zone in a print media advance direction. A control circuit 910 controls the printhead assembly and the cutting assembly to perform printing and cutting operations during a single print media feed (A).

Figure 10:
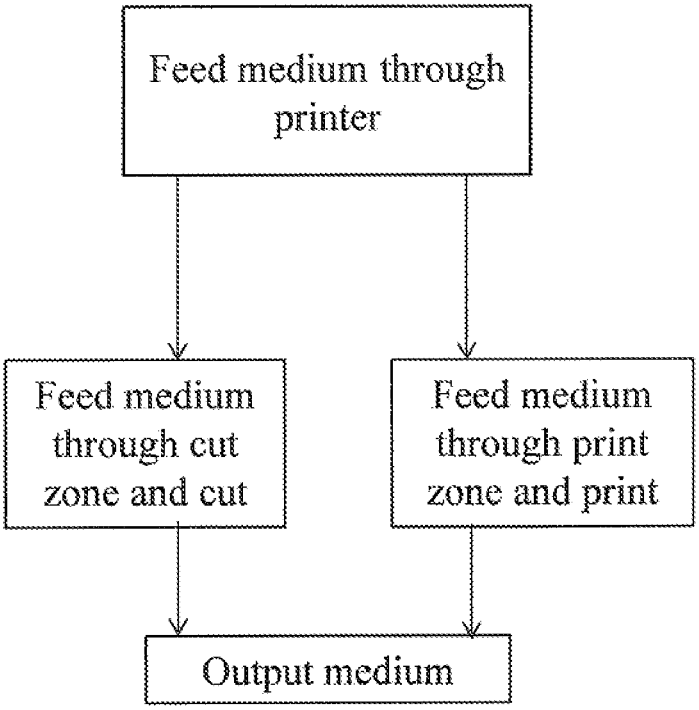
FIG. 10 shows a flow chart of another example of a method of printing.

In one example of a method of printing, schematically shown in FIG. 10, the method comprises feeding a print media through a printer, the printer including a printhead assembly for printing on the print media in a print zone and a cutting assembly for cutting the print media in a cut zone. The print zone and the cut zone are distinct from one another, one of the zones being downstream of the respective other zone in a print media advance direction. Feeding the print media through the printer comprises feeding the print media through the cut zone and through the print zone, in any order. It further comprises simultaneously printing an image and cutting a contour while the print media is being fed through the cut zone and through the print zone.

The invention claimed is:

1. A printer comprising:

a printing assembly for printing an image on a print media in a print zone;

a cutting assembly for cutting the print media along a contour in a cut zone, the cutting assembly comprising a tool sled moveable in a direction parallel to, and a direction perpendicular to, a print media advance direction;

wherein the print zone and the cut zone are distinct from one another, one of the zones being downstream of the respective other zone in the print media advance direction;

a control unit controlling the printhead assembly and the cutting assembly to perform printing and cutting operations during a single print media feed.

2. The printer of claim 1, wherein the control unit controls the printing and cutting operations as a function of dynamics of at least one of the printing assembly and the cutting assembly and wherein the print zone and the cut zone are arranged in a print media pathway for simultaneously printing a given image and cutting a given contour.

3. The printer of claim 1, wherein the control unit divides a contour to be cut into a number of sections, wherein each section has a length, in the direction of the print media advance, which is smaller than the length of the cut zone.

4. The printer of claim 3, wherein the length of each section is about ½ of the length of the cut zone, and the width of the section corresponds to the width of the cut zone.

5. The printer according to claim 1, wherein the print zone is downstream of the cut zone in the print media advance direction, and wherein the print media is advanced only in the print media advance direction without moving the print media forwards and backwards relative to the print media advance direction.

6. The printer according to claim 1, wherein the printhead assembly and the cutting assembly are implemented in separate subsystems, each subsystem including a carriage.

7. A printer according to claim 1, wherein the cutting assembly comprises a laser device.

8. The printer of claim 1, herein the control unit is to feed a print media through the printer;

wherein feeding the print media through the printer comprises feeding the print media through the cut zone and through the print zone, in any order; and the control unit to further simultaneously print an image with the printing assembly and cut a contour with the cutting assembly while the print media is being fed through the cut zone and through the print zone, wherein the print media is advanced only in the print media advance direction without moving the print media forwards and backwards relative to the print media advance direction.

9. The printer of claim 8, the control unit to further determine a media advance speed as a function of the time necessary for printing at least part of the image and for cutting at least part of the contour in predetermined sections of the print media.

10. The printer of claim 8, the control unit to further adjust the media advance speed according to a slower one of the printing operation and the cutting operation.

11. The printer of claim 8, the control unit having an input for receiving a print job, the print job including printing and cutting instructions, and the control unit to process the print job to determine a media advance profile.

12. The printer of claim 11, wherein the control unit to determine the media advance profile based on a cutting time necessary for completing a cutting operation in a first section of the print media, wherein the media advance profile includes a print media advance speed adjusted to provide for the necessary cutting time, and wherein the printing operation is adapted by the control unit to the print media advance speed.

13. The printer of claim 8, wherein the control unit of the printer is further programmed to receive a print job, including an image to be printed and a contour to be cut on the same print media wherein the contour to be cut is divided into a number of sections, each section having a length dimension which is smaller than the length of the cut zone in the media advance direction.

14. The printer of claim 13, the control unit to further determine the coordinates of the contour to be cut in each section and determine a time necessary to cut a respective contour within each section to determine a media advance speed.

15. The printer of claim 1, wherein a plane of the print zone and a plane of the cut zone are arranged at right angles to each other.

16. The printer of claim 1, wherein the cutting assembly comprises a cutting tool carriage which moves the tool sled perpendicular to the print media advance direction and a sled rail on which the tool sled moves parallel to the print media advance direction.

17. A printer comprising:

a printing assembly for printing an image on a print media in a print zone;

a cutting assembly for cutting the print media along a contour in a cut zone;

wherein the print zone and the cut zone are distinct from one another, one of the zones being downstream of the respective other zone in a print media advance direction;

a control unit controlling the printhead assembly and the cutting assembly to perform printing and cutting operations during a single print media feed, wherein the control unit is programmed for:

receiving a print job, the print job defining an image to be printed and a contour to be cut on a same print media;

dividing the contour to be cut is into a number of sections, each section having a length dimension which is smaller than a length of the cut zone in the media advance direction;

determining a media advance speed as a function of an amount of time necessary for printing at least part of the image and for cutting at least part of the contour in predetermined sections of the print media;

feeding a print media through the printer, wherein feeding the print media comprises feeding the prim media first through the cut zone and then through the print zone for simultaneously cutting a contour and printing an image while the print media is being fed through the cut zone and through the print zone.

18. A printer comprising:

a printing assembly for printing an image on a print media in a print zone;

a cutting assembly for cutting the print media along a contour in a cut zone, wherein the printing assembly is downstream from the cutting assembly in a print media advance direction;

a control unit controlling the printhead assembly and the cutting assembly to perform simultaneous printing and cutting operations during a single print media feed, wherein the print media is advanced only in the print media advance direction without moving the print media forwards and backwards relative to the print media advance direction.

19. The printer of claim 18, wherein the cutting assembly comprises a tool sled moveable in a direction parallel to, and a direction perpendicular to, the print media advance direction.

20. The printer of claim 18, wherein the cutting assembly comprises a chemical cutting fluid cartridge.

* * * * *